US012337247B2

(12) United States Patent
Christou

(10) Patent No.: US 12,337,247 B2
(45) Date of Patent: Jun. 24, 2025

(54) BALANCING LEVER GAME

(71) Applicant: Geoffrey Giles Christou, Dunchurch (CA)

(72) Inventor: Geoffrey Giles Christou, Dunchurch (CA)

( * ) Notice: Subject to any disclaimer, the term of this patent is extended or adjusted under 35 U.S.C. 154(b) by 551 days.

(21) Appl. No.: 17/898,209

(22) Filed: Aug. 29, 2022

(65) Prior Publication Data

US 2023/0082537 A1 Mar. 16, 2023

Related U.S. Application Data

(60) Provisional application No. 63/243,281, filed on Sep. 13, 2021.

(51) Int. Cl.
*A63F 9/26* (2006.01)

(52) U.S. Cl.
CPC ..... *A63F 9/26* (2013.01)

(58) Field of Classification Search
CPC ..... A63F 9/26
See application file for complete search history.

(56) References Cited

U.S. PATENT DOCUMENTS 3,567,221 A * 3/1971 Stults ..... G09B 23/02 177/250
3,764,134 A * 10/1973 Reinertsen ..... A63F 9/26 273/287
3,829,096 A * 8/1974 Gioia ..... A63F 7/386 273/110
4,200,292 A * 4/1980 Slimp, Jr. ..... A63F 9/26 273/287
4,354,682 A * 10/1982 Vcala ..... A63F 9/26 434/110
4,358,110 A * 11/1982 Youkstetter ..... A63F 9/26 273/455
4,389,049 A * 6/1983 Wiley ..... A63F 9/06 273/153 R
4,579,346 A 4/1986 Giuntoli
4,589,664 A * 5/1986 Slimp, Jr. ..... A63F 3/00 273/449
4,638,999 A * 1/1987 Keska ..... A63F 9/26 273/287

(Continued)

FOREIGN PATENT DOCUMENTS

CA 1118462 A 2/1982
GB 2240725 A * 8/1991 ..... A63F 9/26

*Primary Examiner* — Raleigh W Chiu
(74) *Attorney, Agent, or Firm* — H&I PARTNERS; Chai Im; C. Andrew Im

(57) ABSTRACT

A balancing lever game with game pieces including beams, movable loads, and fulcrums that players may use to create balanced compound lever systems. The balancing lever game can be played singly, or with multiple players. The game pieces may be used to arrange and re-arrange the beams and a plurality of movable load game pieces of different mass and sizes to create a balanced system where no beam game pieces are touching the ground or leaning on each other. Starting with a main fulcrum game piece, a grooved beam game piece, and load game pieces, a player tries to balance the first beam game piece on a fulcrum with loads on either side of the first beam. To advance to the next level, the player places a beam game piece on top of a load game piece, and then seeks to balance the two beam game pieces.

8 Claims, 5 Drawing Sheets

(56) References Cited

U.S. PATENT DOCUMENTS

| | | | | | |
|---|---|---|---|---|---|
| 4,640,509 | A * | 2/1987 | Manspeaker | ..... | A63F 9/26<br>273/450 |
| 4,872,673 | A * | 10/1989 | Hanley | ..... | A63F 9/26<br>D21/399 |
| 5,954,340 | A * | 9/1999 | Tedesco | ..... | A63F 9/26<br>273/449 |
| 2014/0110902 | A1 * | 4/2014 | Thompson | ..... | A63F 9/26<br>273/450 |

* cited by examiner

BALANCING LEVER GAME

RELATED APPLICATION

This applicant claims the benefit of provisional application No. 63/243,281 filed Sep. 13, 2021, which is incorporated herein by reference in its entirety.

FIELD OF THE INVENTION

The present invention relates to a game, and more specifically to a balancing lever game with game pieces that players may use to create balanced compound lever systems, including beams, movable loads, and fulcrums.

BACKGROUND OF THE INVENTION

Games of chance, and games of skill, as well as combination games of skill and chance, are known. Users of games of skill may experience more success with superior judgment and hand/eye coordination, and repetition and memory are also contributors to success. Games of skill include games that tilt, and correctly placing or moving game pieces to avoid tilting (or to cause the opponent to tilt) is the object of the game.

A tiltable board game apparatus is described in U.S. Pat. No. 4,589,664 issued May 20, 1986, and corresponding Canadian Patent 1,118,462 issued Feb. 16, 1982, in which a game board on a fulcrum is caused to tilt by the movement of pieces of various weights positioned on the board. An object of the game is to fill the edge of the board with playing pieces on the side opposite the other player to cause the board to tilt. The board may tilt to touch the underlying surface and moving a weighted piece can restore equilibrium.

Another tiltable game board with the same object of the game is described in U.S. Pat. No. 4,579,346 issued Apr. 1, 1986, in which a game board on a fulcrum is caused to tilt by the movement of pieces of various weights positioned on the board in depressions in the board.

However, each of these known games provide limited modularity given the single game board. These games do not provide for building compound lever systems. What is needed is a game that provides for building lever and compound lever systems that amuses users with various opportunities for combinations of game pieces, development of hand/eye co-ordination, a plurality of possible game plays, variety of game pieces and board game piece configurations, as well as continued engagement and stimulation for users, and beginner to advanced levels of play.

SUMMARY OF THE INVENTION

In an embodiment of the present invention there is a balancing lever game comprising multiple game pieces from which levers may be built, said game pieces comprising at least one main fulcrum and at least one beam capable of balancing on the main fulcrum, and one or more movable loads, wherein the beam comprises one or more apertures, and each aperture is sized both for a load to rest on and for an aperture to pivotably fit on top of a load to act as a fulcrum for a beam.

The loads may be sphere shaped and the apertures correspondingly circular shaped and the loads may be of one or more weights.

The beam additionally comprises at least one groove sized to fit pivotably on the main fulcrum.

In a further embodiment of the balancing lever game there are at least two beams, at least two loads, and one fulcrum.

In a further embodiment of the present invention there is use of the balancing lever game to build a lever or to build a compound lever.

In a further embodiment of the present invention there is a kit for building levers comprising at least two or more beams, at least one main fulcrum and a plurality of loads, wherein at least one of the two or more beams is capable of balancing on the main fulcrum, the two or more beams each comprise at least two or more apertures, and each aperture is sized both for a load to rest on and for an aperture to pivotably fit on top of a load to act as a fulcrum for a beam.

BRIEF DESCRIPTION OF THE FIGURES

These and other aspects of the present invention will be apparent from the brief description of the drawings and the following detailed description in which.

DETAILED DESCRIPTION OF THE INVENTION

Figure 1:
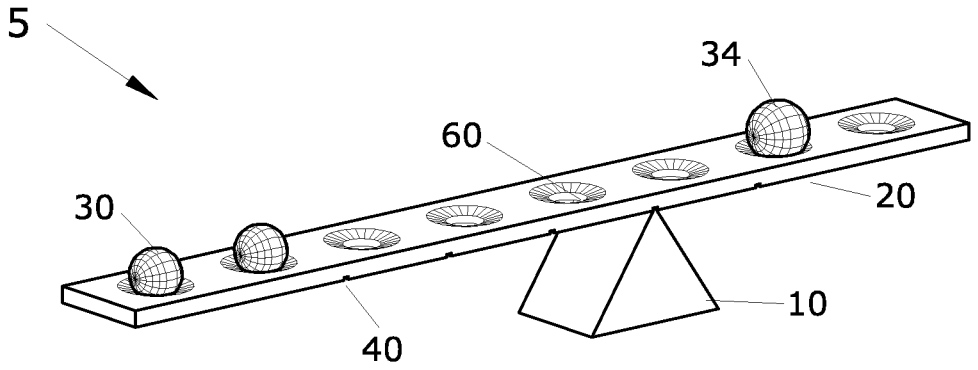
FIG. 1 is a perspective view of an embodiment of a balancing game of the present invention with one beam.

In an embodiment of the present invention there is a balancing lever game 5 as seen in FIGS. 1 to 9 in which the game pieces comprise a main fulcrum 10, one or more beams 20, movable loads which in this example are shown as a first load 30, second load 34 and third load 38, and apertures 60 to hold the loads 30, 34, 38. In this example, the loads are spherical and the apertures 60 are correspondingly circular shaped and shaped to rest on or under a load without it passing through. In this example, the loads increase in size and weight from first load 30, to second load 34 to third load 38. The beam and main fulcrum may be made of wood, and the loads of glass, though it is to be understood that materials such as steel, aluminum, metal, plastic, stone, concrete, engineered wood, resin, and other materials can be used for these elements.

FIG. 1 shows an initial game state with one beam 20 balanced on the main fulcrum 10, in which the top of the main fulcrum 10 rests in one of a series of grooves 40 in the bottom of the beam 20. In this example, a Class 1 Lever is created since the main fulcrum is located between equal forces on either side, namely, two first loads and ⅝ of the beam 20 on one side, and one second load and ⅜ of the beam 20 on the other side. In a Class 1 Lever the fulcrum is between equal forces to achieve a balanced lever. In a Class 1 Lever the force of the effort ($F_e$) multiplied by the distance of the effort from the fulcrum ($d_e$) is equal to the force of the resistance ($F_r$) multiplied by the distance of the resistance from the fulcrum ($d_r$). In the present invention the load could be the second load 34 being placed in the seventh aperture on the beam 20 followed by the force of two first loads 30 being place on the other end of the beam in the first and second apertures, and the force being equal, creating a balanced lever.

Figure 2:
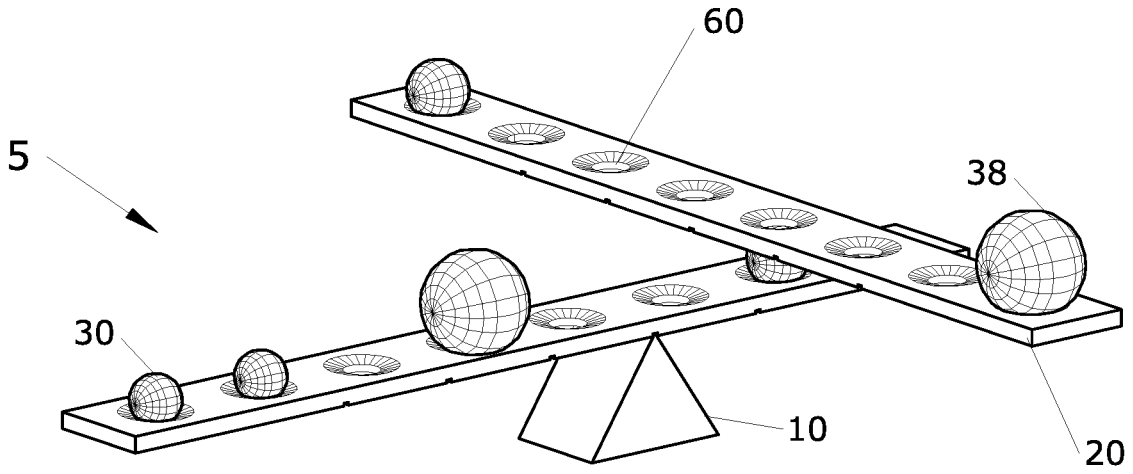
FIG. 2 is a perspective view of an embodiment of a balancing game of the present invention with two beams.

As shown in FIG. 2, a second beam 20 is added above the balancing game 5 of FIG. 1 and additional loads 30, 34, 38 are added to create a Compound Lever that is in balance, i.e., the added Class 1 Lever acts as the effort/load on the end of the Class 1 Lever from FIG. 1. It will be understood that the game may be set up from scratch to start at various configurations of game pieces, for example, with one beam resting on a fulcrum and holding one load and a second beam resting on that load. The loads are sized to not only fit in the top aspect of the aperture but also fit in the bottom aspect of the aperture so that the aperture of a beam pivotably fits on top of a load and the load acts as a fulcrum for the beam.

Figure 3:
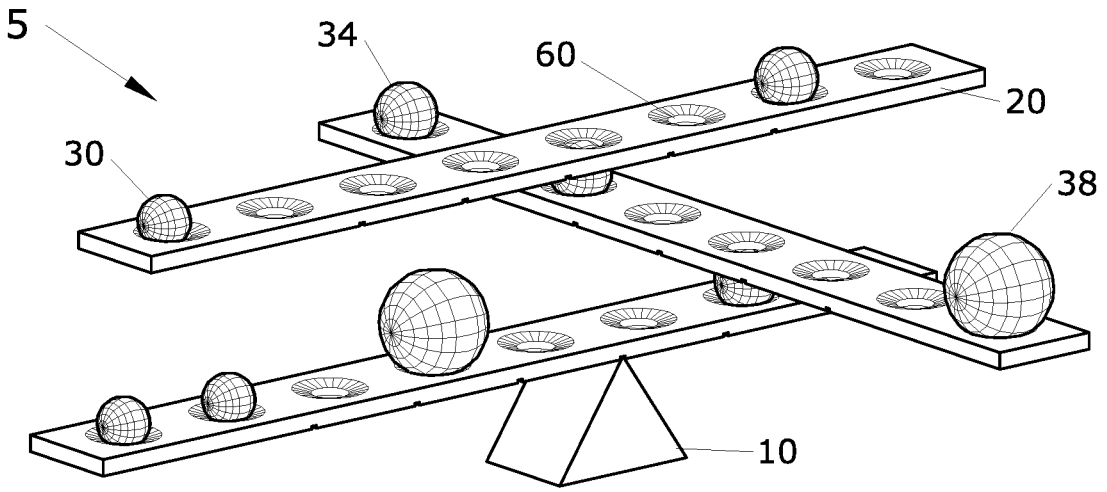
FIG. 3 is a perspective view of an embodiment of a balancing game of the present invention with three beams.

As shown in FIG. 3, a third beam 20 is added above the balancing game 5 of FIG. 2 and additional loads 30, 34, 38 are added to create a more complex Compound Lever, i.e., one Class 1 Lever acts as the force on the end of another Class 1 Lever that itself acts as the force on the end of another Class 1 Lever (building on FIGS. 1 and 2).

Figure 4:
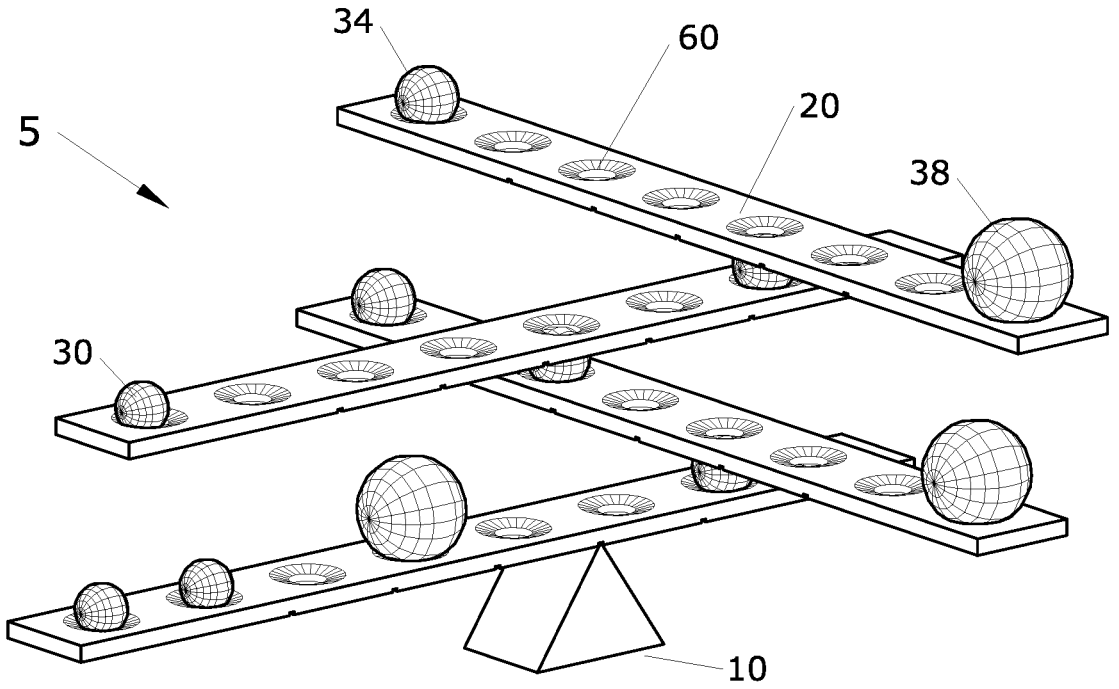
FIG. 4 is a perspective view of an embodiment of a balancing game of the present invention with four beams.

As shown in FIG. 4, a fourth beam 20 is added above the balancing game 5 of FIG. 3 and additional loads 30, 34, 38 are added to create an even more complex Compound Lever, i.e., one Class 1 Lever acts as the force on the end of another Class 1 Lever, that acts as the force on the end of another Class 1 Lever, that itself acts as the force on the end of another Class 1 Lever (building on FIGS. 1, 2, and 3).

Figure 5:
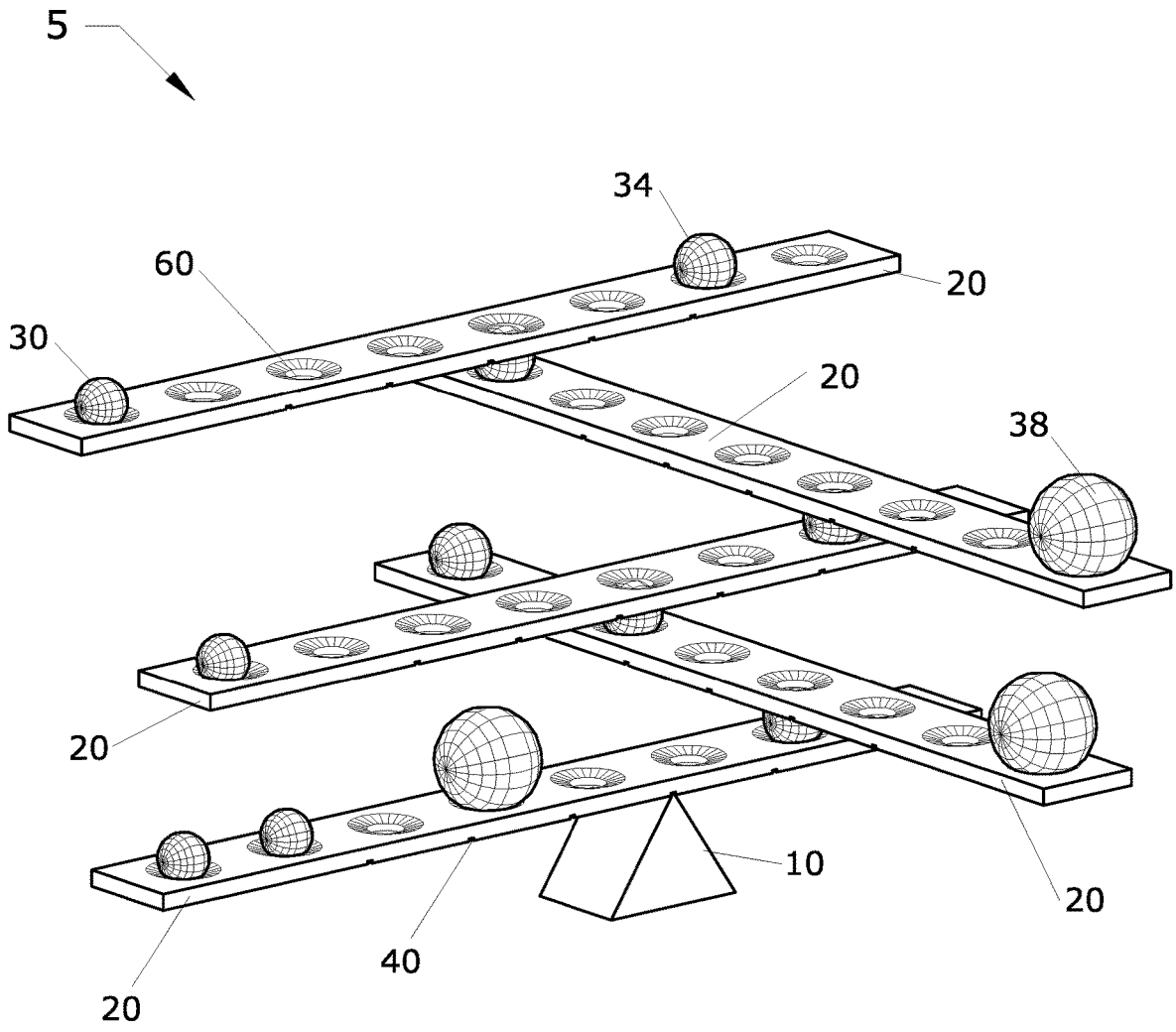
FIG. 5 is a perspective view of an embodiment of a balancing game of the present invention with five beams.

As shown in FIG. 5, a fifth beam 20 is added above the balancing game 5 of FIG. 4 and additional loads 30, 34, 38 are added to create an even more complex Compound Lever. Beams may be added successfully with increasing user skill at the game.

Figure 6:
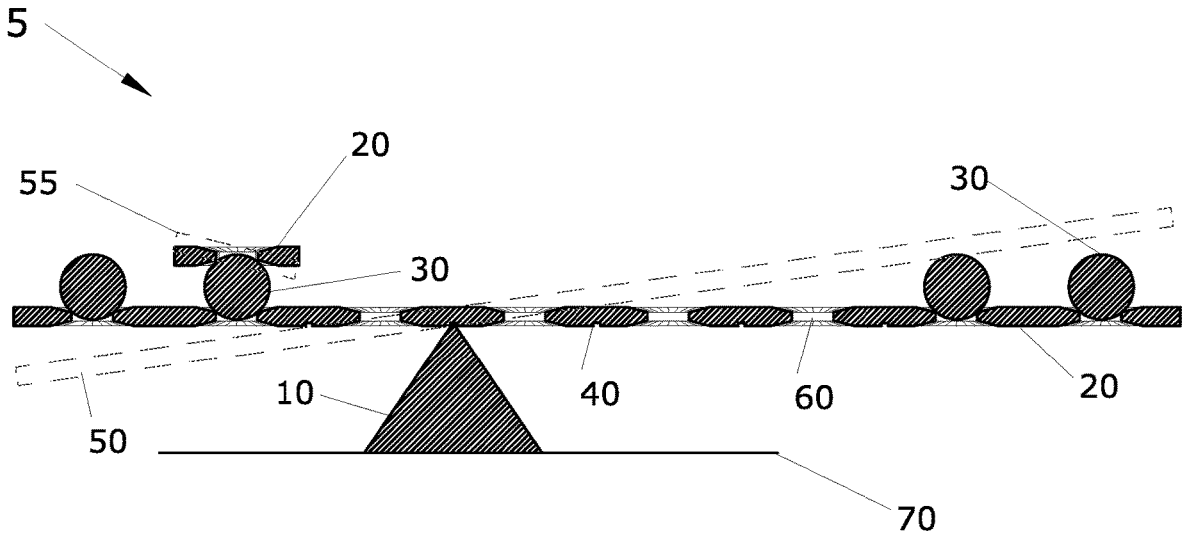
FIG. 6 is a cross-sectional view of the balancing game of FIG. 2, shown resting on a flat surface.

FIG. 6 depicts the balancing game 5 of FIG. 1 in a cross-section view showing the short and long cross-sectional shape of the apertures 60 on the beam 20 as well as the profile of the apertures 60, and the grooves 40 on the bottom of the beam 20. Depending on the shape of the loads, different cross-sectional shapes could be used for the apertures 60. A beam 20 will tilt lengthwise on the main fulcrum 10 when a force is placed on one end and a lengthwise degree of freedom 50 is shown by a dashed line. The beam 20 also tilts crosswise on the load 30 which crosswise degree of freedom 55 is also shown with a dashed line. The main fulcrum 10 is shown resting on a flat surface 70, which could be a table, floor, counter, cabinet etc. On a large enough flat surface 70, the maximum lengthwise degree of freedom 50 would be when the beam 20 tilts to touch the flat surface 70.

Figure 7:
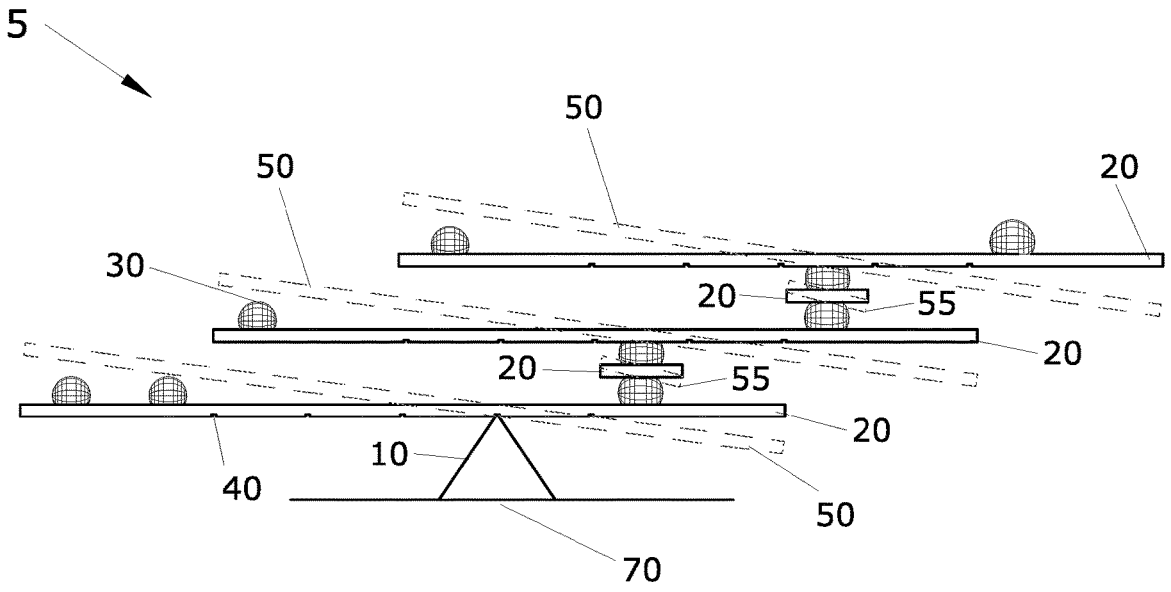
FIG. 7 is a side view of the balancing game of FIG. 5, shown resting on a flat surface.

FIG. 7 depicts the balancing game 5 of FIG. 5 in a side view showing the lengthwise degree of freedom 50 and crosswise degree of freedom 55.

Figure 8:
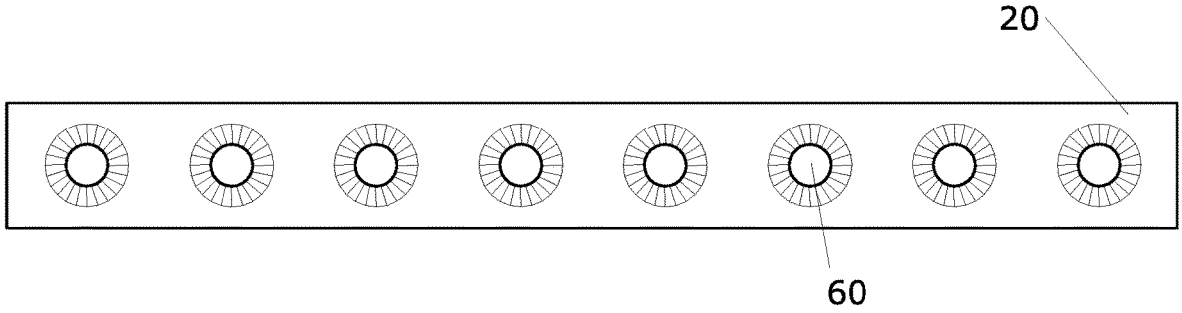
FIG. 8 is a top view of a beam of an embodiment of a balancing game of the present invention.
Figure 9:
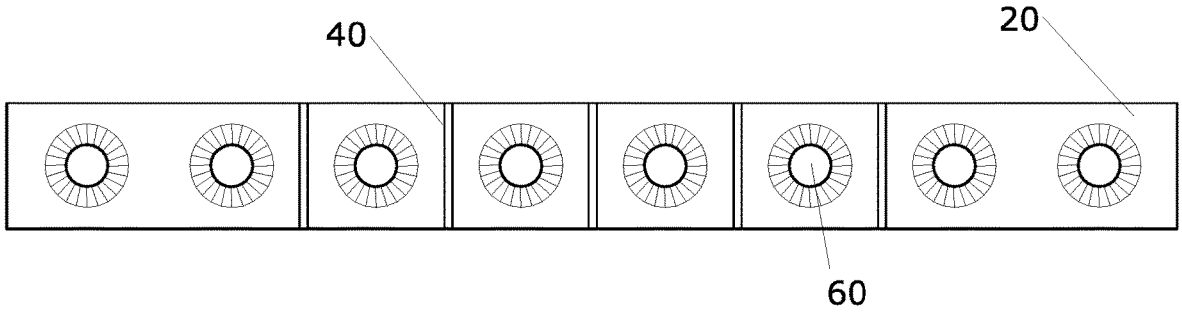
FIG. 9 is a bottom view of the beam of FIG. 8.

FIGS. 8 and 9 show the top and bottom, respectively, of an embodiment of a beam 20 of the present invention showing the arrangement of the apertures 60, and the location of the grooves 40 on the underside of the first beam 20 which receive the main fulcrum 10. While the apertures 60 extend in an even number across the entire beam 20, there are no grooves at each end of the beam 20 between the last two apertures 60 since it is not possible to achieve a balanced lever with the game pieces shown in the figures if the main fulcrum 10 was in an end groove 40 (not shown). However, it will be understood that grooves 40 could be placed at the ends of the beam 20.

The balancing lever game of the present invention may amuse players by allowing them to use the game pieces including beams 20, loads 32, 34, 38, and main fulcrum 10 to create a Class 1 Lever and to create a variety of balanced compound lever systems. The playing surface 70 consists of any surface sufficiently sized to allow game play and is relatively flat.

The playing pieces of a balancing lever game may include multiple beam 20 game pieces with apertures 60 sufficient to snuggly hold the loads 30, 34, 38, at least one beam 20 having grooves 40 on the bottom; load game pieces of a plurality of sizes, and at least one main fulcrum 10 game piece to rest on a playing surface 70 that can balance the beam 20 via the top of the fulcrum fitting into one of the grooves 40. The load game pieces are shaped in a way that allows them to rest within the apertures 60 of the beams 20, as well as shaped to allow their use as fulcrums for a beam 20 that rests on a load 32, 34, 38. While the loads and apertures are shown in the figures with texture for ease of visualizing, and may have a texture or design, it is understood that the loads and apertures may also be smooth, textured or marked in any way that still permits the loads to fit into the apertures.

Because of this modular structure of the game pieces, there are many possible configurations in which a player can balance the game pieces. While the grooves 40 in the beam 20 allow it to balance on a main fulcrum 10 and thus the beams 20 balancing on loads do not need grooves, they may still have them. Further, a game kit may include multiple main fulcrums 10 along with multiple beams with grooves in order to allow for parallel play, and also to create more complex compound lever systems.

The game can be played singly, or with multiple players. The game pieces may be used to arrange and re-arrange the beams and a plurality of movable load game pieces of different mass and sizes to create a balanced system where no beam game pieces are touching the playing surface 70 or leaning on each other. Starting with a main fulcrum game piece, a grooved beam game piece, and load game pieces, a player tries to balance the first beam game piece on a fulcrum with loads on either side of the first beam. To advance to the next level, the player places a beam game piece on top of a load game piece, and then seeks to balance the two beam game pieces. More advanced players can advance to multiple beam game pieces. The game may start in other ways, for example, the game may start with unbalanced levers and the goal is to add loads to bring the levers into balance.

It is possible to time the game play, to compete against others, to collaborate as a team, to create sets of rules based on cards, dice, or other rules of play. A goal of the balancing lever game may be for players to balance as many beams 20 as possible using two identical sets of game pieces or alternatively using an identical number of beams but a random allotment of loads 32, 34 38 picked from a bag or chosen through dice or other means. Players may take turns on the same system or play in parallel. Games may be timed to see who can create the most balanced levers on their respective systems first. Alternatively, games may not be timed, and each person takes their turn in order. Players may each get the same game pieces to work with or may get to choose pieces from an opaque bag. Alternatively, all the game pieces may be up for grabs as players build their compound lever systems until all the game pieces are used up and/or until a set time is reached.

A player's hands help the game pieces balance. This makes for an engaging, hands-on-experience while using the game pieces and developing hand/eye co-ordination. While the first beam 20 is resting on the main fulcrum 10 and there is only one axis of rotation (like a traditional seesaw or teeter-totter) it is relatively easy to create a balanced lever system. When players add an additional beam game piece on top of a load 32, 34 38, the beams 20 can tip both up and down, and also left and right as shown in FIGS. 6 and 7 at the lengthwise degree of freedom 50 and crosswise degree of freedom 55 and therefore the player's hands stabilize and assist in the game play. Alternatively, a game could be played in which hands are not allowed for stabilizing and loads are placed without touching the beams 20.

The apertures may alternatively be comprised of matching concave depressions on the top and bottom of a thicker beam without a hole in between, and one aperture could hold a load on top and have a load underneath. The apertures 60 may be other shapes, for example, a plus sign shape or a square on top and circle on bottom, all of which may be beveled/chamfered, and for using with corresponding-shaped loads.

The beams 20 in the embodiment of the invention shown in the figures are in the shape of rectangular prisms, but the beams could be various shapes and profiles. There are one or more apertures spaced along the beam game pieces length to hold the load game pieces in position. The apertures on the beams game pieces are shaped on the top and bottom surfaces to allow a plurality of load pieces to rest firmly within the apertures.

On the underside of at least one of the beams 20, there are one or more groves 40 running in the short direction. The grooves dictate the location of the initial balancing point of the game play. The shape of the grooves 40 on the beam is such that a groove 40 fits over the balancing point of the main fulcrum 10 game piece. The main fulcrum 10 has a shape such that it has at least one balancing point that allows the grooves 40 on the beam 20 to rest squarely and securely on the main fulcrum 10, while also allowing the beam 20 to pivot on top of the main fulcrum game piece in the direction of the lengthwise degree of freedom 50.

There may be a plurality of load game pieces of different size and mass, which fit in the apertures 60 on the beams 20. The load game pieces are shaped such that they suitable for use as fulcrums for the addition of multiple beams 20, on top of the first starting beam 20. Larger size loads may be lighter and smaller sized loads may be heavier to add difficulty in achieving balanced levers. Although an even number of apertures 60 on a beam 20 aids in balancing levers, the beams may have odd numbers of apertures 60 or unevenly spaced apertures 60 to add complexity to the balancing. Further some beams 20 could be of different lengths and have different spacing and/or number of apertures, and even have different sized apertures with corresponding different sized loads for increased complexity.

Although the figures show the levers in balance to demonstrate a possible goal of the game, it will be understood that players may not be able to achieve balanced levers if restricted by time limits or limits on attempted tries or by skill and difficulty.

The present invention includes a kit for building levers and compound levers comprising at least two or more beams, at least one main fulcrum and a plurality of loads, wherein at least one of the two or more beams is capable of balancing on a main fulcrum, the two or more beams each comprise at least one aperture each, and each aperture is sized both for a load to rest on and for an aperture to pivotably fit on top of a load to act as a fulcrum for a beam.

A kit of the balancing lever game may comprise a variety of game pieces and when combined with another kit will increase the extent and/or variety of game play and/or number of players.

While embodiments of the invention have been described in the detailed description, the scope of the claims should not be limited by the preferred embodiments set forth in the examples, but should be given the broadest interpretation consistent with the description as a whole.

The invention claimed is:

1. A balancing lever game comprising multiple game pieces from which levers may be built, said game pieces comprising at least one main fulcrum and at least one beam capable of balancing on the main fulcrum, and one or more movable loads, wherein the beam comprises one or more apertures, and each aperture is sized both for a load to rest on and for an aperture to pivotably fit on top of a load to act as a fulcrum for a beam.

2. The balancing lever game of claim 1, wherein the loads are sphere shaped and the apertures are circular shaped.

3. The balancing lever game of claim 2, wherein the beam additionally comprises at least one groove sized to fit pivotably on the main fulcrum.

4. The balancing lever game of claim 3, wherein the movable loads are of one or more weights.

5. The balancing lever game of claim 1 in which there are at least two beams, at least two loads, and one fulcrum.

6. The balancing lever game of claim 1, wherein the multiple game pieces form a lever.

7. The balancing lever game of claim 5, wherein the multiple game pieces form a compound lever.

8. A kit for building levers comprising at least two or more beams, at least one main fulcrum and a plurality of loads, wherein at least one of the two or more beams is capable of balancing on the main fulcrum, the two or more beams each comprise at least four apertures, and each aperture is sized both for a load to rest on and for an aperture to pivotably fit on top of a load to act as a fulcrum for a beam.

* * * * *